US011057713B2

(12) United States Patent
Nagaoka

(10) Patent No.: US 11,057,713 B2
(45) Date of Patent: Jul. 6, 2021

(54) VIBRATABLE ELEMENT FOR LOUDSPEAKER USE AND LOUDSPEAKER DEVICE

(71) Applicant: HOSIDEN CORPORATION, Yao (JP)

(72) Inventor: Satofumi Nagaoka, Yao (JP)

(73) Assignee: Hosiden Corporation, Yao (JP)

( * ) Notice: Subject to any disclaimer, the term of this patent is extended or adjusted under 35 U.S.C. 154(b) by 0 days.

(21) Appl. No.: 16/790,223

(22) Filed: Feb. 13, 2020

(65) Prior Publication Data

US 2020/0280806 A1 Sep. 3, 2020

(30) Foreign Application Priority Data

Feb. 28, 2019 (JP) ..... JP2019-036562

(51) Int. Cl.

| | |
|---|---|
| ***H04R 9/06*** | (2006.01) |
| ***H04R 1/28*** | (2006.01) |
| ***H04R 9/04*** | (2006.01) |

(52) U.S. Cl.

CPC ..... *H04R 9/06* (2013.01); *H04R 1/2811* (2013.01); *H04R 9/043* (2013.01); *H04R 9/046* (2013.01)

(58) Field of Classification Search

CPC ..... H04R 9/043; H04R 9/06; H04R 1/2811
See application file for complete search history.

(56) References Cited

U.S. PATENT DOCUMENTS

| | | | | |
|---|---|---|---|---|
| 9,014,412 | B2 | 4/2015 | Humphreys et al. | |
| 2007/0140519 | A1* | 6/2007 | Fukuyama | H04R 7/16 381/398 |
| 2011/0135141 | A1* | 6/2011 | Tanabe | H04R 9/025 381/413 |

FOREIGN PATENT DOCUMENTS

| | | | |
|---|---|---|---|
| CN | 107666642 | A | 2/2018 |
| FR | 2866777 | A3 | 8/2005 |
| JP | S58-111499 | A | 7/1983 |

OTHER PUBLICATIONS

Extended European Search Report for European Application No. EP 20152989.8, published by the European Patent Office (EPO), dated Jun. 25, 2020, including corresponding Communication, 3-page EPO Form 1703, 1-page Annex, and 1 page Information on Search Strategy.

* cited by examiner

*Primary Examiner* — Sunita Joshi
(74) *Attorney, Agent, or Firm* — Kilyk & Bowersox, P.L.L.C.

(57) ABSTRACT

A vibratable element for loudspeaker use including a coil bobbin, a voice coil attached thereto, and a main body being constituted by a single thin plate and including a fixing portion, a damper portion, a vibrating portion, and an edge portion. The fixing portion is a part of the plate to which the coil bobbin is fixed from one side in a first direction being the axial direction of the voice coil. The damper portion is a part of the plate located inside the fixing portion. The vibrating portion is a part of the plate located outside the fixing portion. The inside refers to a side toward the center of the plate, and the outside refers to a side away from the center of the plate. The edge portion is a part of the plate outside the vibrating portion and includes an outer perimeter portion of the plate.

17 Claims, 6 Drawing Sheets

VIBRATABLE ELEMENT FOR LOUDSPEAKER USE AND LOUDSPEAKER DEVICE

CROSS-REFERENCE TO RELATED APPLICATION

The present application claims priority under 35 U.S.C. § 119 of Japanese Patent Application No. 2019-036562 filed on Feb. 28, 2019, the disclosure of which is expressly incorporated by reference herein in its entirety.

BACKGROUND OF THE INVENTION

Technical Field

The invention relates to vibratable elements for loudspeakers and loudspeaker devices.

Background Art

Japanese Unexamined Patent Publication No. S58-111499 A describes a conventional vibratable element for loudspeaker use. The vibratable element includes a core material, a skin material, a cylindrical coil bobbin, and a voice coil. The core material is a wire cloth impregnated with a thermosetting resin, and includes a damper portion being an inner perimeter portion of the core material, an edge portion being an outer perimeter portion of the core material, and a middle portion. The skin material is aluminum foil or the like attached to the upper and lower surfaces of the middle portion of the core material. The coil bobbin is fixed to the outer peripheral edge of the damper portion. The voice coil is wound around the coil bobbin.

SUMMARY OF INVENTION

The above conventional vibratable element has a structure in which the skin material is attached to the core material, i.e. requires a larger number of components.

The invention provides a vibratable element for loudspeaker use and a loudspeaker device having a reduced number of components.

A vibratable element for loudspeaker use according to an aspect of the invention includes a coil bobbin, a voice coil attached to the coil bobbin, and a main body constituted by a single thin plate. The main body includes a fixing portion, a damper portion, a vibrating portion, and an edge portion. The fixing portion is a part of the thin plate to which the coil bobbin is fixed from one side in a first direction. The first direction is the axial direction of the voice coil. The damper portion is a part of the thin plate located inside the fixing portion. The vibrating portion is a part of the thin plate located outside the fixing portion. The inside refers to a side toward the center of the thin plate, and the outside refers to a side away from the center of the thin plate. The edge portion is a part of the thin plate outside the vibrating portion. The edge portion includes an outer perimeter portion of the thin plate.

The vibratable element of this aspect is structured such that the fixing portion, the damper portion, the edge portion, and the vibrating portion of the main body are constituted by a single thin plate. As such the vibratable element advantageously has a reduced number of components.

The vibrating portion and the edge portion may include a first curved portion generally of a ring shape when viewed from the other side in the first direction, and/or the damper portion may include a second curved portion generally of a ring shape when viewed from the other side in the first direction. The first curved portion may have a pair of generally arc shapes in a cross-sectional view in the first direction. The pair of generally arc shapes may protrude to one or the other side in the first direction. The second curved portion may have a pair of generally arc shapes in a cross-sectional view in the first direction. The pair of generally arc shapes of the second curved portion may protrude to one or the other side in the first direction.

Where the vibrating portion and the edge portion include the first curved portion and the damper portion includes the second curved portion, the first and second curved portions may have different spring constants from each other, or alternatively may have a substantially matched vibration system weight.

In the element of this aspect, the first and second curved portions have non-matching resonance frequencies when the vibratable element vibrates. In other words, the resonance frequencies of the first curved portion and the second curved portion are dispersed. This reduces the possibility of abnormal vibrations, or the rolling/rocking phenomenon, in the vibratable element 100 that may occur if the resonance frequencies of the first and second curved portions match.

Where the vibrating portion and the edge portion include the first curved portion and the damper portion includes the second curved portion, the pair of generally arc shapes of the first curved portion and the pair of generally arc shapes of the second curved portion may protrude in mutually opposite directions in the first direction.

The vibratable element of this aspect is structured such as to vibrate with improved symmetry between the vibration amplitude on the one side in the first direction and the vibration amplitude on the on the other side in the first direction.

The first curved portion may include a first inner perimeter generally of a ring-shape, a first outer perimeter generally of a ring-shape, and a first vertex generally of a ring-shape. The first vertex may be positioned between the first inner perimeter and the first outer perimeter and outside a first midpoint. The first midpoint may be a midpoint of a linear distance from the first inner perimeter to the first outer perimeter.

The second curved portion may include a second inner perimeter generally of a ring-shape, a second outer perimeter generally of a ring-shape, and a second vertex generally of a ring-shape. The second vertex may be positioned between the second inner perimeter and the second outer perimeter and inside a second midpoint. The second midpoint may be a midpoint of a linear distance from the second inner perimeter to the second outer perimeter.

The first curved portion may include the first vertex, a first inner part positioned inside the first vertex, and a first outer part positioned outside the first vertex. The second curved portion may include the second vertex, a second inner part positioned inside the second vertex, and a second outer part positioned outside the second vertex.

The pair of generally arc shapes of the first curved portion and the pair of generally arc shapes of the second curved portion may protrude in mutually opposite directions in the first direction. The first vertex of the first curved portion may be positioned outside the first midpoint. The second vertex of the second curved portion may be positioned inside the second midpoint.

In the vibratable element of this aspect, since the first vertex of the first curved portion is displaced to the outside relative to the first midpoint, the first inner part has a relatively larger dimension and the first outer part has a relatively smaller dimension in the direction orthogonal to the first direction. Also, since the second vertex of the second curved portion is displaced to the inside relative to the second midpoint, the second outer part has a relatively larger dimension and the second inner part has a relatively smaller dimension in the direction orthogonal to the first direction. As such, when the vibratable element vibrates, the first and second curved portions are elastically deformable in manners i) and ii) below.

i) During the vibration of the vibratable element, when the first curved portion is displaced in its protruding direction (the direction in which the first curved portion protrudes) and the second curved portion is displaced in the same direction, the first inner part elastically deforms to a larger degree than the first outer part, and the second inner part elastically deforms to a larger degree than the second outer part thereof. More specifically, the first inner part, having a relatively larger dimension as described above, elastically deforms to become closer to a straight shape, thus reducing the on-center holding force of the main body. By contrast, the second inner part, having a relatively smaller dimension as described above, elastically deforms into a shape with a tighter curve, thus enhancing the on-center holding force of the main body. In short, the on-center holding force of the main body is reduced by the elastic deformation of the first curved portion but enhanced by the elastic deformation of the second curved portion. It is therefore possible to maintain the overall on-center holding force of the main body.

ii) During the vibration of the vibratable element, when the second curved portion is displaced in its protruding direction and the first curved portion is displaced in the same direction, the second outer part elastically deforms to a larger degree than the second inner part, and the first outer part elastically deforms to a larger degree than the first inner part. More specifically, the second outer part, having a relatively larger dimension as described above, elastically deforms to become closer to a straight shape, thus reducing the on-center holding force of the main body. By contrast, the first outer part, having a relatively smaller dimension as described above, elastically deforms into a shape with a tighter curve, thus enhancing the on-center holding force of the main body. In short, the on-center holding force of the main body is reduced by the elastic deformation of the second curved portion but enhanced by the elastic deformation of the first curved portion. It is therefore possible to maintain the overall on-center holding force of the main body.

In both cases i) and ii), since the overall on-center holding force of the main body is maintained, it is possible to reduce the movement of the coil bobbin and the voice coil in any other direction than the first direction (the first direction include the direction in which the first curved portion protrudes and the direction in which the second curved portion protrudes). This reduces the possibility of occurrence of the rolling/rocking phenomenon of the vibratable element.

The first and second curved portions may satisfy the following formula: first distance: second distance ≈ fourth distance: third distance, where a first imaginary line extending from the first inner perimeter to the first outer perimeter may intersect at a first intersection with a second imaginary line extending from the first vertex in the first direction; a third imaginary line extending from the second inner perimeter to the second outer perimeter may intersect at a second intersection with a fourth imaginary line extending from the second vertex in the first direction. The first distance may be a linear distance from the first inner perimeter to the first intersection, the second distance may be a linear distance from the first intersection to the first outer perimeter, the third distance may be a linear distance from the second inner perimeter to the second intersection, and the fourth distance may be a linear distance from the second intersection to the second outer perimeter.

The vibratable element of this aspect makes it easy for the coil bobbin and the voice coil to move reciprocatingly in the first direction when the vibratable element vibrates. This reduces the possibility of occurrence of the rolling/rocking phenomenon of the vibratable element.

The ratio of the first distance to the second distance may be in a range from about 5.5:4.5 to about 8:2. The ratio of the fourth distance to the third distance may be in a range from about 5.5:4.5 to about 8:2.

The first inner part of the first curved portion may curve more gently than the first outer part of the first curved portion. The second outer part of the second curved portion may curve more gently than the second inner part of the second curved portion.

The vibratable element of any aspect described above may further including a dome portion having a higher hardness than the main body. The fixing portion may have a first face on the one side in the first direction and a second face on the other side in the first direction. The coil bobbin may be fixed to the first face of the fixing portion. The dome portion may be fixed to the second face of the fixing portion and covers the damper portion from the other side in the first direction.

In the vibratable element for loudspeaker use of this aspect, the dome portion has a higher hardness than the main body and has a divided resonance frequency of the dome portion that is higher than that of the main body. As such, the vibratable element is adapted to output high-pitched sounds with improved quality.

A loudspeaker device of an aspect of the invention includes the vibratable element according to any one of the aspects described above; a magnetic circuit having a magnetic gap, the magnetic gap receiving the voice coil of the vibratable element; a damper support fixed to the damper portion of the main body of the vibratable element; and a frame fixed to the outer perimeter portion of the edge portion of the main body of the vibratable element. The loudspeaker device of this aspect reduces the possibility of occurrence of the rolling/rocking phenomenon of the vibratable element. This is because the damper portion of the vibratable element is fixed to the damper support, and the outer perimeter portion of the edge portion of the vibratable element is fixed to the frame.

BRIEF DESCRIPTION OF DRAWINGS

The present invention can be even more fully understood with the reference to the accompanying drawings which are intended to illustrate, not limit, the present invention.

Figure 1A:
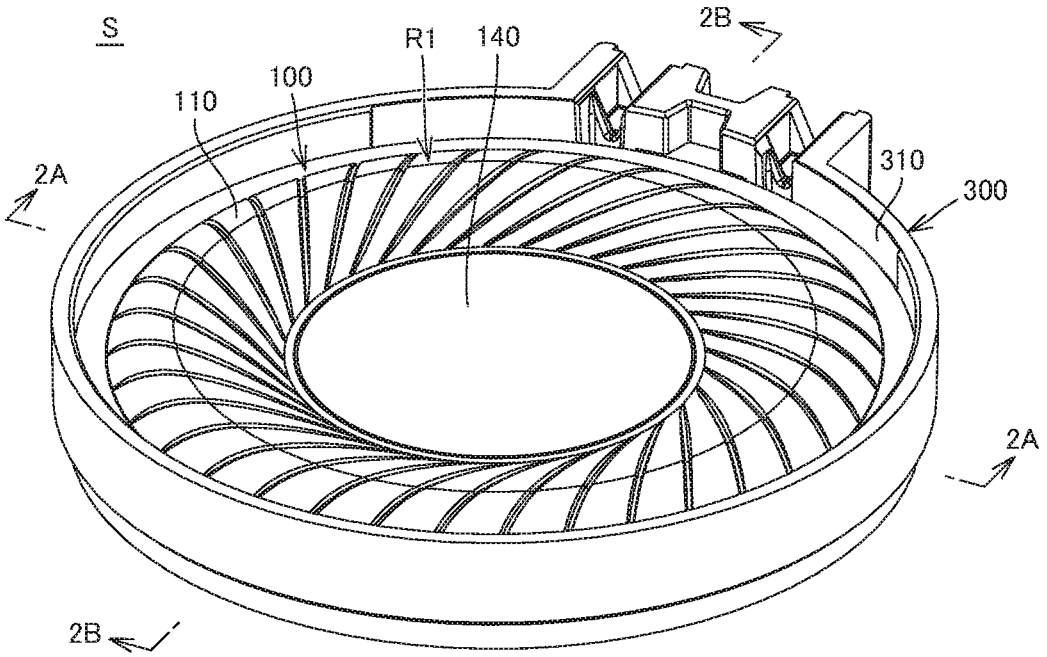
FIG. 1A is a front, top, right side perspective view of a loudspeaker device according to a first embodiment of the invention.
Figure 1B:
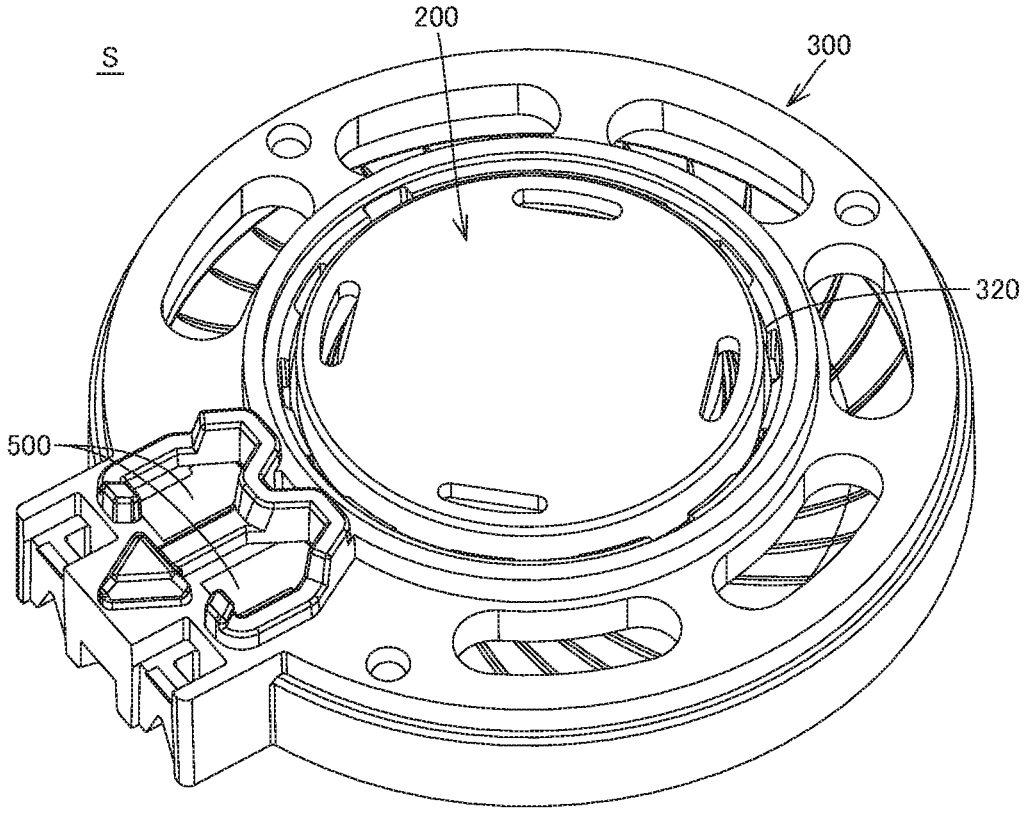
FIG. 1B is a back, bottom, right side perspective view of the loudspeaker device.

In the brief description of the drawings above and the description of embodiments which follows, relative spatial terms such as "upper", "lower", "top", "bottom", "left", "right", "front", "rear", etc., are used for the convenience of the skilled reader and refer to the orientation of the vibratable elements for loudspeakers, the loudspeaker devices, and their constituent parts as depicted in the drawings. No limitation is intended by use of these terms, either in use of the invention, during its manufacture, shipment, custody, or sale, or during assembly of its constituent parts or when incorporated into or combined with other apparatus.

DESCRIPTION OF EMBODIMENTS

The following discussion is directed to various embodiments of the invention. It should be noted that elements of embodiments and their variants to be described can be combined in any possible manners.

First Embodiment

The following is a description of a loudspeaker device S (which may be hereinafter referred to simply as a loudspeaker S) according to a plurality of embodiments including a first embodiment of the invention, with reference to FIGS. 1A to 5. FIGS. 1A to 4B illustrate the loudspeaker S according to the first embodiment. FIG. 5 illustrates a first variant of the loudspeaker S according to the first embodiment.

Figure 3A:
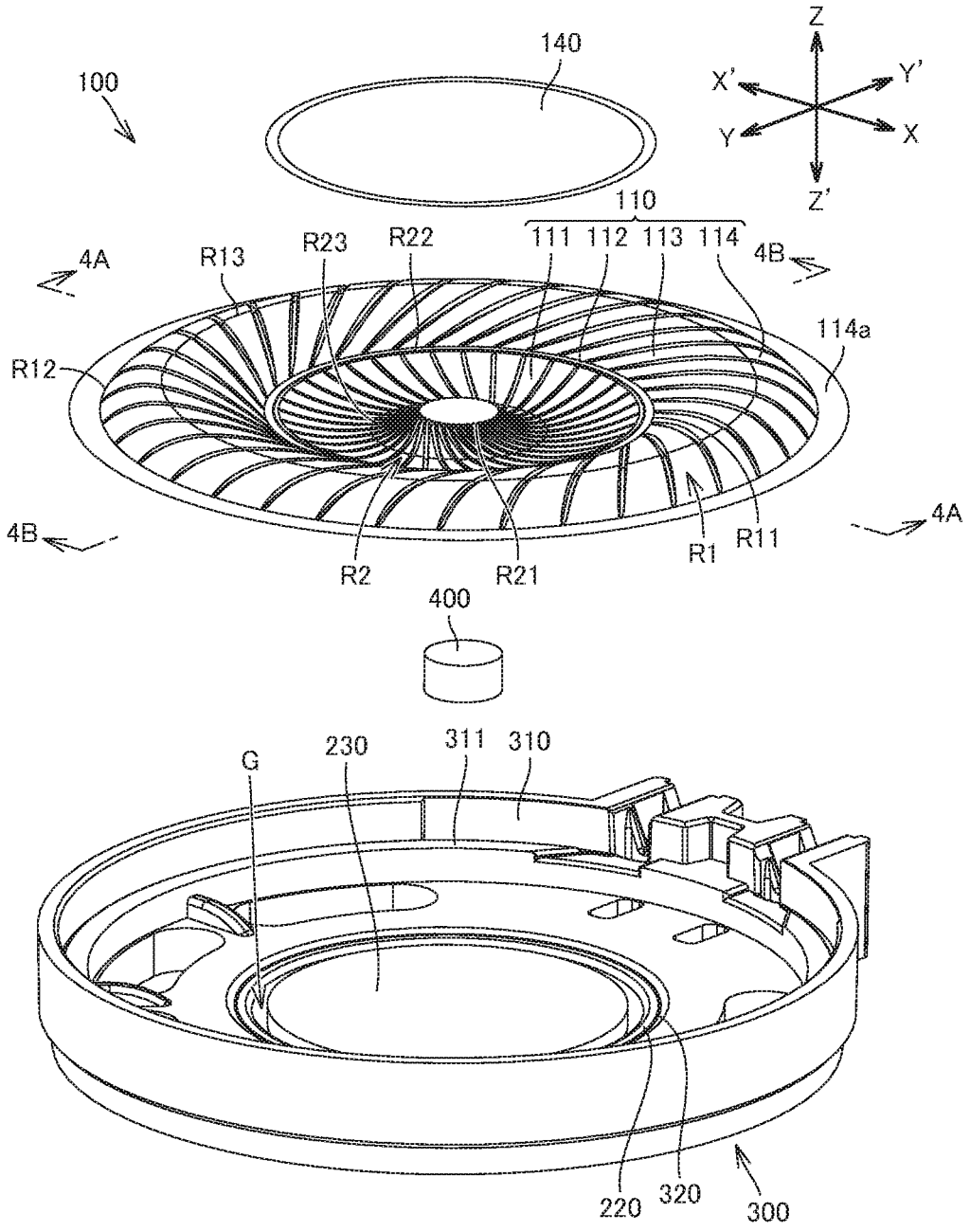
FIG. 3A is an exploded, front, top, right side perspective view of the loudspeaker device.
Figure 3B:
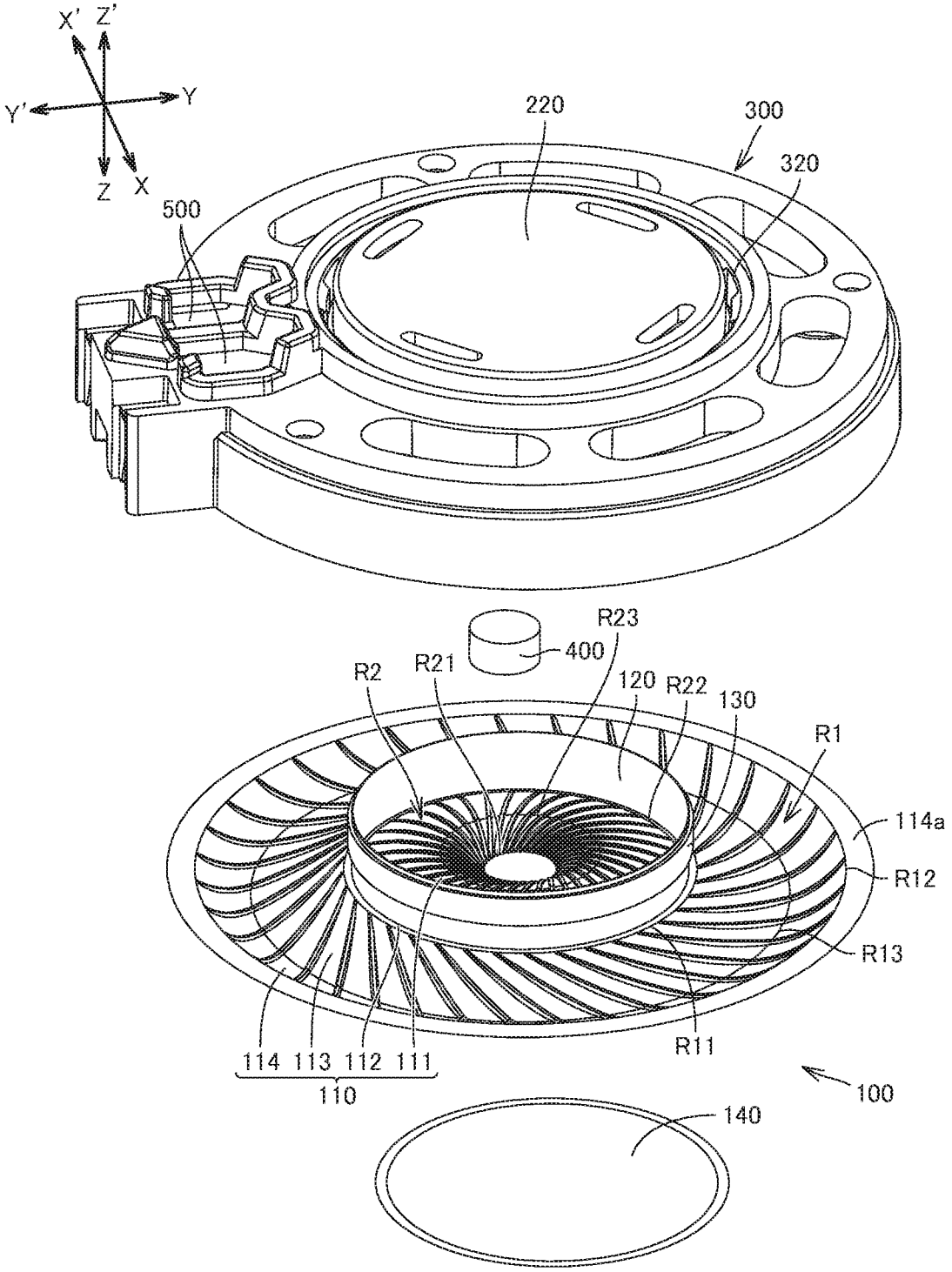
FIG. 3B is an exploded, back, bottom, right side perspective view of the loudspeaker device.
Figure 4A:
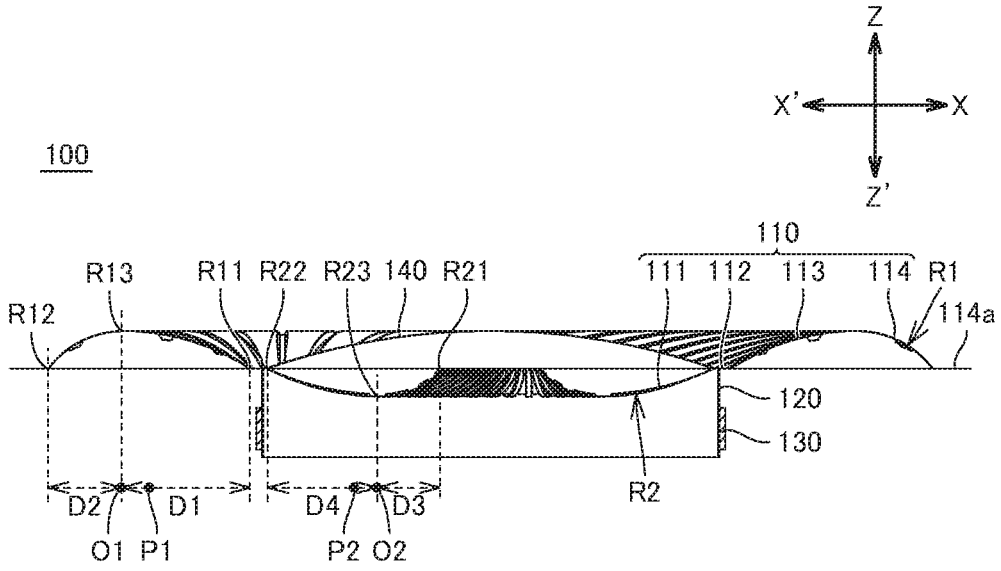
FIG. 4A is a cross-sectional view of a vibratable element of the loudspeaker device taken along line 4A-4A in FIG. 3A.
Figure 4B:
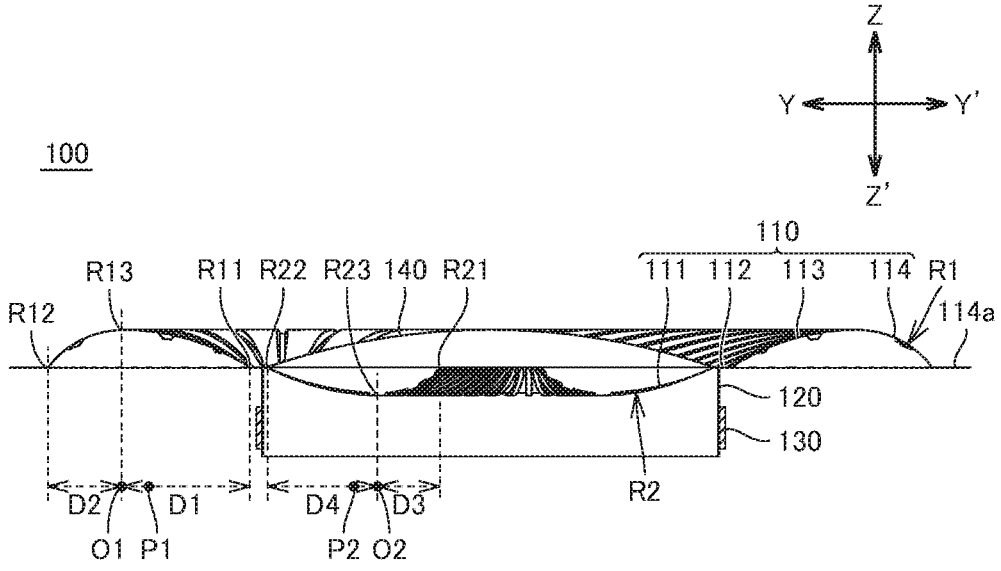
FIG. 4B is a cross-sectional view of the vibratable element, taken along line 4B-4B in FIG. 3A.
Figure 5:
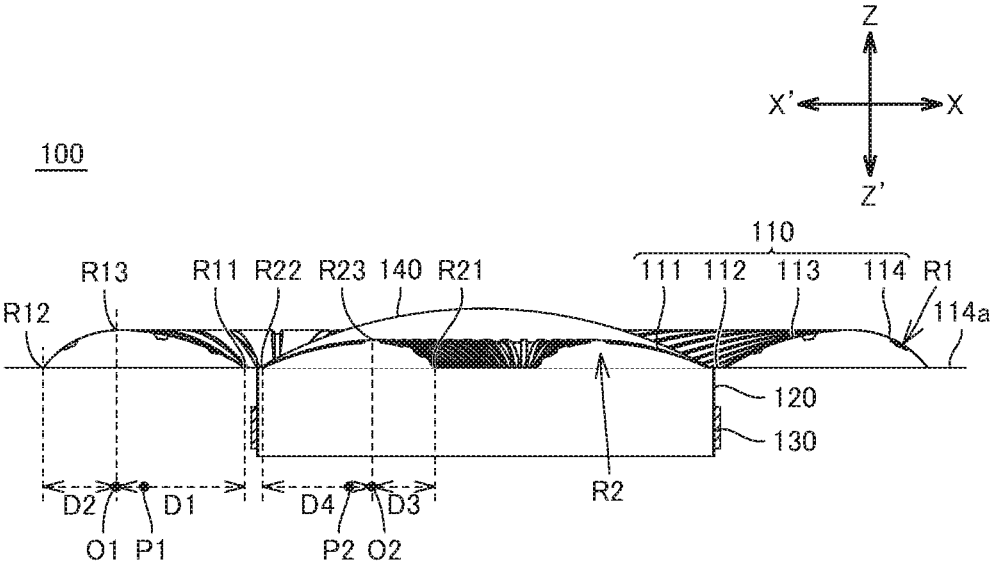
FIG. 5 is a cross-sectional view, corresponding to FIG. 4A, of a first variant of the vibratable element according to the first embodiment.

It should be noted that FIGS. 3A to 4B and FIG. 5 show a Z-Z' direction corresponding to the first direction. The Z-Z' direction includes a Z' direction, corresponding to one side in the first direction, and a Z direction, corresponding to the other side in the first direction. The Z direction corresponds to a sound emission direction of the loudspeaker S, and the Z' direction corresponds to the opposite direction to the sound emission direction. FIGS. 3A, 3B, 4A, and 5 show an X-X' direction, and FIGS. 3A, 3B, and 4B show a Y-Y' direction. The X-X' and Y-Y' directions are substantially orthogonal to the Z-Z' direction.

The loudspeaker S includes a vibratable element 100, which may be referred to as a "vibratable element for loudspeaker use." The vibratable element 100 includes a main body 110, a coil bobbin 120, and a voice coil 130.

The coil bobbin 120 is generally tubular, having a circular or polygonal cross section, for example. The voice coil 130 is wound around, and attached to, the outer circumferential surface of the coil bobbin 120. It should be noted that the Z-Z' direction also corresponds to the axial direction of the coil bobbin 120.

The main body 110 is constituted by a single thin plate made of a metal foil, paper, woven fabric, nonwoven fabric, a film, etc. The film may be formed of a synthetic resin, some example of which include polyolefins (e.g. polyethylene (PE) or polypropylene (PP)), polyesters (e.g. polyethylene terephthalate (PET) or polyethylene naphthalate (PEN)), polyimide (PI), polyether ketone (PEK), polyphenylene sulfide (PPS), and polyetherimide (PEI).

The main body 110 includes a damper portion 111, a fixing portion 112, a vibrating portion 113, and an edge portion 114. The fixing portion 112 is a portion of the single thin plate having a shape corresponding to the shape of the coil bobbin 120, i.e. generally has a ring shape (such as circular or polygonal ring shape). The fixing portion 112 has a first face on the Z'-direction side and a second face on the Z-direction side. The coil bobbin 120 is fixed from the Z'-direction side to the first face of the fixing portion 112, with an adhesive, a double-sided tape, or the like means. The damper portion 111 has a ring shape (such as circular or polygonal ring shape) when viewed from the Z-direction side. The damper portion 111 is a part of the single thin plate inside the fixing portion 112. In FIG. 1A to FIG. 4B, the damper portion 111 is the inner perimeter portion of the single thin plate, located inside the fixing portion 112. The damper portion 111 has its own inner perimeter. The vibrating portion 113 is a part of the single thin plate outside the fixing portion 112. The edge portion 114 is a part of the single thin plate outside the vibrating portion 113. The edge portion 114 is contiguous with the vibrating portion 113 and serves as a so-called "fixed-edge" of the vibratable element for loudspeaker use. The edge portion 114 has an outer perimeter portion 114*a* of the single thin plate. In the invention, "inside" refers to the side toward the center of the single thin plate and/or toward the axis of the coil bobbin 120, and "outside" refers to the side away from the center of the single thin plate and/or away from the axis of the coil bobbin 120.

The vibrating portion 113 and the edge portion 114 in combination may include a first curved portion R1 generally of a ring shape (such as circular or polygonal ring shape) when viewed from the Z-direction side. The first curved portion R1 is so curved as to protrude in the Z or Z' direction. The first curved portion R1 has a pair of generally arc shapes in a cross-sectional view in the Z-Z' direction. These generally arc shapes protrude in the Z or Z' direction. These generally arc shapes are preferably, but are not required to be, positioned and shaped symmetrically with respect to the axis of the coil bobbin 120.

The outer perimeter portion 114*a* of the edge portion 114 may be in a flat ring shape extending to the outside from the first curved portion R1.

The damper portion 111 may include a second curved portion R2 generally of a ring shape (such as circular or polygonal ring shape) when viewed from the Z-direction side. The second curved portion R2 is so curved as to protrude in the Z or Z' direction. The second curved portion R2 has a pair of generally arc shapes in a cross-sectional view in the Z-Z' direction. These generally arc shapes protrude in the Z or Z' direction. These generally arc shapes are preferably, but are not required to be, positioned and shaped symmetrically with respect to the axis of the coil bobbin 120.

The inner perimeter of the damper portion 111 may, without limitation, correspond to the second inner perimeter R21 of the second curved portion R2 as illustrated in FIGS. 1 to 4B. Alternatively, the damper portion 111, or the perimeter portion of the thin plate, may extend further to the inside than the second inner perimeter R21 of the second curved portion R2.

The pair of generally arc shapes of the first curved portion R1 and the pair of generally arc shapes of the second curved portion R2 may protrude in mutually opposite directions in the Z-Z' direction. Particularly, the pair of generally arc shapes of the first curved portion R1 may protrude in the Z direction, and the pair of generally arc shapes of the second curved portion R2 may protrude in the Z' direction as shown in FIG. 1 to FIG. 4B, or vice versa.

The first curved portion R1 has a first inner perimeter R11 generally of a ring-shape, a first outer perimeter R12 generally of a ring-shape, and a first vertex R13 generally of a ring-shape. The first inner perimeter R11 and the first outer perimeter R12 may be positioned at the same height in the Z-Z' direction as illustrated in FIGS. 1 to 4B. Alternatively, the first outer perimeter R12 may be positioned on the Z- or Z'-direction side with respect to the first inner perimeter R11. The first vertex R13 is positioned between, and on the Z- or Z'-direction side with respect to, the first inner perimeter R11 and the first outer perimeter R12. As best illustrated in FIGS. 4A and 4B, the first vertex R13 may be positioned outside the first midpoint P1, which is the midpoint of the linear distance from the first inner perimeter R11 to the first outer perimeter R12. In this case, the part of the first curved portion R1 positioned inside the first vertex R13 (this portion will be referred to simply as the "first inner part" of the first curved portion R1) curves more gently than the part of the first curved portion R1 positioned outside the first vertex R13 (this portion will be referred to simply as the "first outer part" of the first curved portion R1). As used herein the term "midpoint" of a (linear) distance means the point that is equidistant from both endpoints of the distance.

The second curved portion R2 has the aforementioned second inner perimeter R21 generally of a ring-shape, a second outer perimeter R22 generally of a ring-shape, and a second vertex R23 generally of a ring-shape. The second inner perimeter R21 and the second outer perimeter R22 may be positioned at the same height in the Z-Z' direction as illustrated in FIGS. 1 to 4B. Alternatively, the second outer perimeter R22 may be positioned on the Z- or Z'-direction side with respect to the second inner perimeter R21. Also, the second vertex R23 is positioned between, and on the Z- or Z'-direction side with respect to, the second inner perimeter R21 and the second outer perimeter R22. As best illustrated in FIGS. 4A and 4B, the second vertex R23 may be positioned inside the second midpoint P2, which is the midpoint of the linear distance from the second inner perimeter R21 to the second outer perimeter R22. In this case, the part of the second curved portion R2 outside the second vertex R23 (this portion will be referred to simply as the "second outer part" of the second curved portion R2) curves more gently than the part of the second curved portion R2 inside the second vertex R23 (this portion will be referred to simply as the "second inner part" of the second curved portion R2).

Here, first to fourth imaginary lines, first and second intersections O1, O2, and the first to fourth distances D1-D4 are defined as follows. The first imaginary line extends from the first inner perimeter R11 to the first outer perimeter R12, and the second imaginary line extends from the first vertex R13 in the Z-Z' direction. The first intersection O1 is the intersection of the first and second imaginary lines. The third imaginary line extends from the second inner perimeter R21 to the second outer perimeter R22, and the fourth imaginary line extends from the second vertex R23 in the Z-Z' direction. The second intersection O2 is the intersection of the third and fourth imaginary lines. The first distance D1 is the linear distance from the first inner perimeter R11 to the first intersection O1, the second distance D2 is the linear distance from the first intersection O1 to the first outer perimeter R12, the third distance D3 is the linear distance from the second inner perimeter R21 to the second intersection O2, and the fourth distance D4 is the linear distance from the second intersection O2 to the second outer perimeter R22.

Where the first vertex R13 is positioned outside the first midpoint P1, the relationship between the first distance D1 and the second distance D2 may be as follows: preferably the first distance D1 > the second distance D2; more preferably, the ratio of the first distance D1 to the second distance D2 is in a range from about 5.5:4.5 to about 8:2; and further preferably the ratio of the first distance D1 to the second distance D2 is about 7:3. In any of these cases, the first inner part of the first curved portion R1 has a relatively larger dimension in the direction orthogonal to the Z-Z' direction, i.e. curves relatively gently, while the first outer part of the first curved portion R1 has a relatively smaller dimension in the direction orthogonal to the Z-Z' direction, i.e. curves relatively tightly.

Where the second vertex R23 is positioned outside the second midpoint P2, the relationship between the fourth distance D4 and the third distance D3 may be as follows: preferably the fourth distance D4 > the third distance D3; more preferably, the ratio of the fourth distance D4 to the third distance D3 is in a range from about 5.5:4.5 to about 8:2; and further preferably the ratio of the fourth distance D4 to the third distance D3 is about 7:3. In any of these cases, the second outer part of the second curved portion R2 has a relatively larger dimension in the direction orthogonal to the Z-Z' direction, i.e. curves relatively gently, while the second inner part of the second curved portion R2 has a relatively smaller dimension in the direction orthogonal to the Z-Z' direction, i.e. curves relatively tightly.

The distance relationship may be, but is not required to be such that the first distance D1: the second distance D2 ≈ the fourth distance D4: the third distance D3. In the context of the invention, the first distance D1: the second distance D2 ≈ the fourth distance D4: the third distance D3 includes the following relation: the first distance D1: the second distance D2=the fourth distance D4: the third distance D3.

The first curved portion R1 and the second curved portion R2 of any of the above aspects may have corrugations. Where the first curved portion R1 has corrugations, in a cross-sectional view of the thin plate in the Z-Z' corrugations direction, each of the pair of generally arc shapes of the first curved portion R1 has at least one groove and/or at least one ridge of the corrugations. Where the second curved portion R2 has corrugations, in a cross-sectional view of the thin plate in the Z-Z' direction, each of the pair of generally arc shapes of the second curved portion R2 includes the section of at least one groove and/or the section of at least one ridge of the corrugations. In other words, the "generally arc shape" in the context of the invention means not only a simple arc shape but also a generally arc shape including the section of at least one groove and/or the section of at least one ridge of the corrugations. For convenience of illustration, the corrugation is omitted on the surface on the Z'-direction side of the first curved portion R1 and the surface on the Z-direction side of the second curved portion R2 in FIGS. 2A, 2B, 4A, and 4B.

It is preferable that the first and second curved portions R1, R2 of any of the above aspects have different spring constants from each other but have a substantially matched vibration system weight. Such relationship, i.e. matched vibration system weights in combination with different spring constants, can be obtained, for example, by forming the thin plate such that the first curved portion R1 includes a round shape that is entirely or partly different from that of the second curved portion R2.

In some embodiments, the first vertex R13 of the first curved portion R1 of any of the above aspects may be positioned, not outside the first midpoint P1, but on the Z- or the Z'-direction side with respect to the first midpoint P1. Also, in this case, the first inner part of the first curved portion R1 may or may not curve more gently than the first outer part of the first curved portion R1. The second vertex R23 of the second curved portion R2 of any of the above aspects may be positioned, not outside the second midpoint P2, but on the Z- or the Z'-direction side with respect to the second midpoint P2. Also, in this case, the second outer part of the second curved portion R2 may or may not curve more gently than the second inner part of the second curved portion R2.

The pair of generally arc shapes of the first curved portion R1 of any of the above aspects may protrude in the same direction in the Z-Z' direction (i.e. in Z direction as shown in FIG. 5 or in the Z' direction) as the pair of generally arc shapes of the second curved portion R2 of any of the above aspects.

It should be noted that it is possible to omit the first curved portion R1 and/or the second curved portion R2 of any of the above aspects. Where the first curved portion R1 is omitted, the vibrating portion 113 and the edge portion 114 may be of a flat shape extending outward from the fixing portion 112. Where the second curved portion R2 is omitted, the damper portion 111 may be of a flat shape extending inward from the fixing portion 112.

The vibratable element 100 may further include a dome portion 140 of a dome shape protruding to the Z direction. The dome portion 140 may be made of the same or a similar material as that of the main body 110. The dome portion 140 has a higher hardness than the main body 110. This may be because the dome portion 140 has a larger plate thickness than the main body 110. For example, the dome portion 140 may have a plate thickness of 75 μm, and the main body 110 may have a plate thickness of 30 μm. The dome portion 140 may have the same plate thickness as, or a smaller plate thickness than, the main body 110.

The dome portion 140 has an outer perimeter portion. The outer perimeter portion of the dome portion 140 is fixed to the second face of the fixing portion 112 of the main body 110 of any of the above aspects with an adhesive, a double-sided tape, or the like. The dome portion 140 covers the damper portion 111 of the main body 110 from the Z-direction side. Where the damper portion 111 has the second curved portion R2 having the pair of generally arc shapes in a cross-sectional view in the Z-Z' direction protruding in the Z direction, the dome portion 140 may have such a height that the dome portion 140 will not interfere with the second curved portion R2 (see FIG. 5).

Figure 2A:
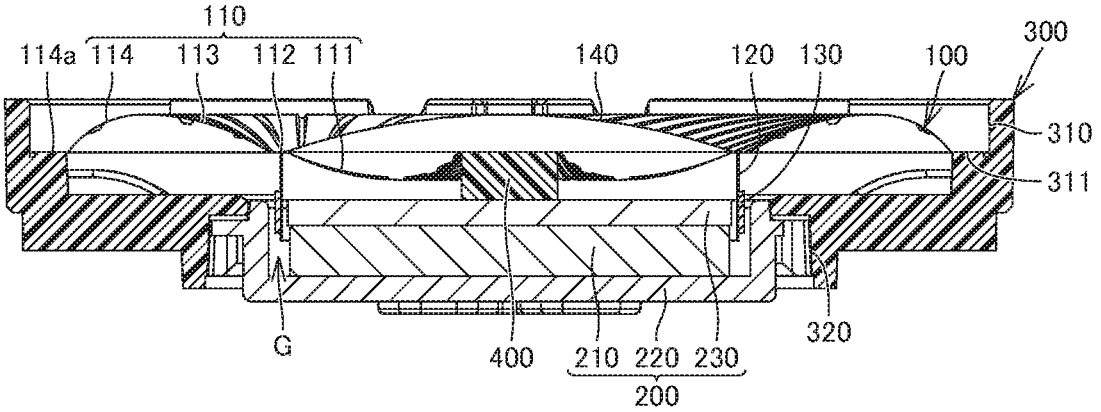
FIG. 2A is a cross-sectional view of the loudspeaker device, taken along line 2A-2A in FIG. 1A.
Figure 2B:
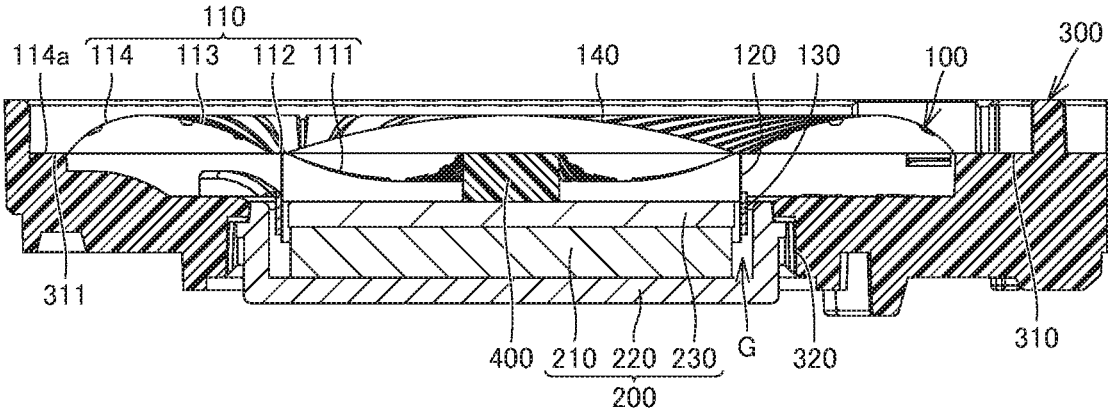
FIG. 2B is a cross-sectional view of the loudspeaker device, taken along line 2B-2B in FIG. 1A.

The loudspeaker S further includes a magnetic circuit 200. The magnetic circuit 200 has a magnetic gap G. The magnetic circuit 200 includes a permanent magnet 210, a yoke 220, and a pole piece 230, as best illustrated in FIGS. 2A and 2B.

The yoke 220 may generally be a tube having a circular or polygonal cross section and a bottom. More particularly, the yoke 220 may include a bottom, and a side wall generally of a tubular shape having a circular or polygonal cross section. The side wall extends in the Z-Z' direction from the outer perimeter of the bottom. In this case, the permanent magnet 210 is disposed on the bottom of the yoke 220. The pole piece 230 is placed on the permanent magnet 210 and inside the yoke 220. The magnetic gap G, generally of a tubular shape having a circular or polygonal cross section, is formed between the combination of the permanent magnet 210 and the pole piece 230 and the side wall of the yoke 220, or between the pole piece 230 and the side wall of the yoke 220.

Alternatively, the yoke 220 may include a bottom, and a center pole extending in the Z direction from the center portion of the bottom part. In this case, the permanent magnet 210 and the pole piece 230 are generally of a tubular shape having a circular or polygonal cross section, and they are arranged concentrically about the center pole. The magnetic gap G, generally of a tubular shape having a circular or polygonal cross section, is formed between the combination of the permanent magnet 210 and the pole piece 230 and the center pole of the yoke 220, or between the pole piece 230 and the center pole of the yoke 220.

In any case, the magnetic gap G of the magnetic circuit 200 is formed such as to receive the coil bobbin 120 and the voice coil 130 of the vibratable element 100 of any of the above aspects from the Z-direction side. When a voice current is supplied to the voice coil 130, the voice current and the magnetic flux of the magnetic gap G interact so as to provide the voice coil 130 with an electromagnetic force. The electromagnetic force acts as a driving force to the voice coil 130 in the Z-Z' direction so as to vibrate the vibratable element 100 in the Z-Z' direction. The vibration of the vibratable element 100 in the Z-Z' direction causes the main body 110 to be displaced alternately and in the Z direction (the sound emission direction of the loudspeaker S) and in the Z' direction (the direction opposite to the sound emission direction).

The loudspeaker S further includes a frame 300. The frame 300 is made of synthetic resin or other material. The frame 300 is provided with an accommodation recess 310 opening in the Z direction. The accommodation recess 310 accommodates the vibratable element 100 of any of the above aspects. The bottom of the accommodation recess 310 is provided with a support portion 311 generally of a tubular shape having a circular or polygonal cross section. The support portion 311 extends in the Z direction. To the support portion 311 fixed is the outer perimeter portion 114*a* of the edge portion 114 of the vibratable element 100 of any of the above aspects.

A central portion of the bottom of the accommodation recess 310 is provided with an accommodation hole 320 in communication with the accommodation recess 310. The accommodation hole 320 securely accommodates the magnetic circuit 200. The coil bobbin 120 and the voice coil 130 of the vibratable element 100 of any of the above aspects are disposed in the magnetic gap G of the magnetic circuit 200 in the accommodation hole 320. As shown in FIGS. 1A to 4B, the accommodation hole 320 may be a through-hole extending in the Z-Z' direction through the central portion of the bottom of the accommodation recess 310. Alternatively, the accommodation hole 320 may be a blind hole opening in the Z direction.

The loudspeaker S may further include a pair of terminals 500 for connection with an external device. In this case, the frame 300 may be configured to hold the terminals 500. Each terminal 500 may preferably be connected to each of a pair of lead wires drawn out from the voice coil 130 of the vibratable element 100. Where the terminals 500 are omitted, the lead wires may be used for connection with an external device.

The loudspeaker S further includes a damper support 400. The damper support 400 is a circular or polygonal column made of synthetic resin or other material. The damper support 400 may be formed separately from, and fixed to, the pole piece 230 or the center pole of the magnetic circuit 200.

Alternatively, the damper support 400 may be formed integrally with the pole piece 230 or the center pole of the magnetic circuit 200. In any of these cases, the damper support 400 is fixed to the inner perimeter of the damper portion 111 of any of the above aspects and supports the damper portion 111.

The loudspeaker S may further include a baffle (not illustrated). The baffle is attached to the frame 300 so as to cover the accommodation recess 310 from the Z-direction side. In this case, the baffle and the support portion 311 of the frame 300 may hold therebetween the outer perimeter portion 114*a* of the edge portion 114 of the vibratable element 100 of any of the above aspects. The baffle may be omitted.

The loudspeaker S and the vibratable element 100 of any of the aspects described above provide at least the following technical features and effects.

First, the damper portion 111, the fixing portion 112, the vibrating portion 113, and the edge portion 114 of the main body 110 of the vibratable element 100 are constituted by a single thin plate. Such vibratable element 100 and the loudspeaker S having the vibratable element 100 can be fabricated with a reduced number of components.

Second, the vibratable element 100 is structured such as to reduce occurrence of rolling/rocking phenomenon, i.e. when vibrating the vibratable element 100, the vibratable element 100 is unlikely to vibrate in a direction substantially orthogonal to or oblique to the driving direction (the Z-Z' direction) of the voice coil 130 for the following reasons.

(1) The damper portion 111 of the vibratable element 100 is fixed to the damper support 400, and the outer perimeter portion 114*a* of the edge portion 114 of the vibratable element 100 is fixed to the frame 300. In other words, the vibratable element 100 is fixed at two locations, namely, at the damper portion 111 and the edge portion 114 thereof, thus reducing the possibility of occurrence of the rolling/rocking phenomenon of the vibratable element 100.

(2) If the vibratable element 100 is structured such that the first and second curved portions R1, R2 have a matching resonance frequency, abnormal vibration or the rolling/rocking phenomenon may occur in the vibratable element 100. However, in an aspect of the vibratable element 100 where the first and second curved portions R1, R2 of any of the above aspects have different spring constants from each other but have a substantially matched vibration system weight, the first and second curved portions R1, R2 have non-matching resonance frequencies when the vibratable element 100 vibrates. In other words, the resonance frequencies of the first curved portion R1 and the second curved portion R2 are dispersed. This reduces the possibility of the rolling/rocking phenomenon in the vibratable element 100 that may otherwise occur due to the matched resonance frequencies.

(3) The possibility of the rolling/rocking phenomenon is further reduced in a case where the pair of generally arc shapes of the first curved portion R1 protrudes in the Z direction (sound emission direction); the pair of generally arc shapes of the second curved portion R2 protrudes in the Z' direction (opposite to the sound emission direction); the first vertex R13 of the first curved portion R1 is positioned outside the first midpoint P1; and the second vertex R23 of the second curved portion R2 is positioned inside the second midpoint P2. In this aspect, the first and second curved portions R1, R2 are elastically deformable in manners i) and ii) below.

i) When the main body 110 is displaced in the Z direction, the first curved portion R1 is accordingly displaced in the Z direction (the direction in which the curved portion R1 protrudes) and the second curved portion R2 is also displaced in the same direction. In this case, the first inner part of the first curved portion R1 elastically deforms to a larger degree than the first outer part thereof, and the second inner part of the second curved portion R2 elastically deforms to a larger degree than the second outer part thereof. More specifically, the first curved portion R1 is formed such that the first inner part thereof has a relatively larger dimension in the direction orthogonal to the Z-Z' direction and/or curves relatively more gently and elastically deforms to become closer to a straight shape, thus reducing the on-center holding force of the main body 110. By contrast, the second curved portion R2 is formed such that the second inner part thereof has a relatively smaller dimension in the direction orthogonal to the Z-Z' direction and/or curves relatively more sharply and elastically deforms into a shape with a tighter curve, thus enhancing the on-center holding force of the main body 110. In short, the on-center holding force of the main body 110 is reduced by the elastic deformation of the first curved portion R1 but enhanced by the elastic deformation of the second curved portion R2. It is therefore possible to maintain the overall on-center holding force of the main body 110.

ii) When the main body 110 is displaced in the Z' direction, the second curved portion R2 is accordingly displaced in the Z' direction (the direction in which the curved portion R2 protrudes), and the first curved portion R1 is also displaced in the same direction. In this case, the second outer part of the second curved portion R2 elastically deforms to a larger degree than the second inner part thereof, and the first outer part of the first curved portion R1 elastically deforms to a larger degree than the first inner part thereof. More specifically, the second curved portion R2 is formed such that the second outer part thereof has a relatively larger dimension in the direction orthogonal to the Z-Z' direction and/or curves relatively more gently and elastically deforms to become closer to a straight shape, thus reducing the on-center holding force of the main body 110. By contrast, the first curved portion R1 is formed such that the first outer part thereof has a relatively smaller dimension in the direction orthogonal to the Z-Z' direction and/or curves relatively more sharply and elastically deforms into a shape with a tighter curve, thus enhancing the on-center holding force of the main body 110. In short, the on-center holding force of the main body 110 is reduced by the elastic deformation of the second curved portion R2 but enhanced by the elastic deformation of the first curved portion R1. It is therefore possible to maintain the overall on-center holding force of the main body 110.

In both cases i) or ii), i.e. when the main body 110 is displaced in the Z and Z' directions, the overall on-center holding force of the main body 110 is maintained, so that movement of the coil bobbin 120 and the voice coil 130 is reduced in any other direction than the Z-Z' direction (the central axis direction of the coil bobbin 120 and the voice coil 130). This reduces the possibility of occurrence of the rolling/rocking phenomenon of the vibratable element 100.

For similar reasons as in the above aspects of the vibratable element 100, it is also possible to reduce the possibility of occurrence of the rolling/rocking phenomenon of the vibratable element 100 in an aspect where the pair of generally arc shapes of the first curved portion R1 protrudes in the Z' direction, and the pair of generally arc shapes of the second curved portion R2 protrudes in the Z direction, the first vertex R13 of the first curved portion R1 is positioned outside the first midpoint P1, and the second vertex R23 of the second curved portion R2 is positioned inside the second midpoint P2.

(4) It is also possible to reduce the possibility of occurrence of the rolling/rocking phenomenon of the vibratable element 100 in a case where the pair of generally arc shapes of the first curved portion R1 and the pair of generally arc shapes of the second curved portion R2 protrude in the same direction in the Z-Z' direction; the first vertex R13 of the first curved portion R1 is positioned outside the first midpoint P1; and the second vertex R23 of the second curved portion R2 is positioned inside the second midpoint P2. This is because the resonance frequency of the first curved portion R1 is different from that of the second curved portion R2.

Third, the vibratable element 100 is structured such as to vibrate with improved symmetry between the vibration amplitude on the Z-direction side and the vibration amplitude on the Z'-direction side, especially in a case where the vibrating portion 113 and the edge portion 114 in combination have the first curved portion R1; the damper portion 111 has the second curved portion R2; and the pair of generally arc shapes of the first curved portion R1 and the pair of generally arc shapes of the second curved portion R2 protrude in mutually opposite directions in the Z-Z' direction. More particularly, each of the first and second curved portions R1, R2 is more likely to move in its protruding direction than in the opposite direction. Therefore, by forming the first and second curved portions R1 and R2 such that the generally arc shapes of the first curved portion R1 and the generally arc shapes of the second curved portion R2 protrude in mutually opposite directions in the Z-Z' direction, the vibratable element 100 can vibrate with improved symmetry between the vibration amplitude on the Z-direction side and the vibration amplitude on the Z'-direction side.

Fourth, in an aspect where the vibratable element 100 includes the dome portion 140, the dome portion 140 has a higher hardness than the main body 110 and has a divided resonance frequency that is higher than that of the main body 110. As such, the vibratable element 100 is adapted to output high-pitched sounds with improved quality.

Fifth, the loudspeaker S has a reduced dimension in the Z-Z' direction. This is because the damper portion 111 of the vibratable element 100 is fixed to the damper support 400 within the coil bobbin 120. In other words, unused space within the coil bobbin 120 is utilized as the region for fixing the damper portion 111.

The vibratable element for loudspeaker use and the loudspeaker device described above are not limited to the embodiments described above but may be modified in any manner without departing from the scope of claims.

It should be appreciated that the materials, the shapes, the dimensions, the number, the positions, etc. of the elements of the vibratable element for loudspeaker use and the loudspeaker device in the above-described embodiments and their variants are presented by way of example only and can be modified in any manner as long as the same functions can be fulfilled.

The present invention can include any combination of these various features or embodiments above and/or below as set-forth in sentences and/or paragraphs. Any combination of disclosed features herein is considered part of the present invention and no limitation is intended with respect to combinable features.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

REFERENCE SIGNS LIST

S: Loudspeaker device
100: Vibratable element for loudspeaker use
110: Main body
111: Damper portion
112: Fixing portion
113: Vibrating portion
114: Edge portion
114*a*: Outer perimeter portion
R1: First curved portion
R11: First inner perimeter
R12: First outer perimeter
R13: First vertex
R2: Second curved portion
R21: Second inner perimeter
R22: Second outer perimeter
R23: Second vertex
120: Coil bobbin
130: Voice coil
140: Dome portion
200: Magnetic circuit
210: Permanent magnet
220: Yoke
230: Pole piece
G: Magnetic gap
300: Frame
310: Accommodation recess
311: Support portion
320: Accommodation hole
400: Damper support
500: Terminal

What is claimed is:

1. A vibratable element for loudspeaker use, the vibratable element comprising:

a coil bobbin;

a voice coil attached to the coil bobbin; and a main body constituted by a single thin plate, the main body including:

a fixing portion being a part of the thin plate to which the coil bobbin is fixed from one side in a first direction, the first direction being an axial direction of the voice coil, a damper portion being a part of the thin plate located inside the fixing portion, a vibrating portion being a part of the thin plate located outside the fixing portion, wherein the inside refers to a side toward the center of the thin plate and the outside refers to a side away from the center of the thin plate, and an edge portion being a part of the thin plate outside the vibrating portion, the edge portion including an outer perimeter portion of the thin plate, wherein the vibrating portion and the edge portion include a first curved portion generally of a ring shape when viewed from the other side in the first direction, the first curved portion has a first pair of generally arc shapes in a cross-sectional view in the first direction, the first pair of generally arc shapes protruding to one or the other side in the first direction, the damper portion includes a second curved portion generally of a ring shape when viewed from the other side in the first direction, the second curved portion has a second pair of generally arc shapes in a cross-sectional view in the first direction, the second pair of generally arc shapes protruding to one or the other side in the first direction, and the first and second curved portions have different spring constants from each other but have a substantially matched vibration system weight.

2. The vibratable element according to claim 1, wherein the first pair of generally arc shapes of the first curved portion and the second pair of generally arc shapes of the second curved portion protrude in mutually opposite directions in the first direction.

3. The vibratable element according to claim 1, wherein the first curved portion includes:

a first inner perimeter generally of a ring-shape, a first outer perimeter generally of a ring-shape, and a first vertex generally of a ring-shape, wherein the first vertex is positioned between the first inner perimeter and the first outer perimeter and outside a first midpoint, and the first midpoint is a midpoint of a linear distance from the first inner perimeter to the first outer perimeter.

4. The vibratable element according to claim 1, wherein the second curved portion includes:

a second inner perimeter generally of a ring-shape, a second outer perimeter generally of a ring-shape, and a second vertex generally of a ring-shape, wherein the second vertex is positioned between the second inner perimeter and the second outer perimeter and inside a second midpoint, and the second midpoint is a midpoint of a linear distance from the second inner perimeter to the second outer perimeter.

5. A vibratable element for loudspeaker use, the vibratable element comprising:

a coil bobbin;

a voice coil attached to the coil bobbin; and a main body constituted by a single thin plate, the main body including:

a fixing portion being a part of the thin plate to which the coil bobbin is fixed from one side in a first direction, the first direction being an axial direction of the voice coil, a damper portion being a part of the thin plate located inside the fixing portion, a vibrating portion being a part of the thin plate located outside the fixing portion, wherein the inside refers to a side toward the center of the thin plate and the outside refers to a side away from the center of the thin plate, and an edge portion being a part of the thin plate outside the vibrating portion, the edge portion including an outer perimeter portion of the thin plate, wherein the vibrating portion and the edge portion include a first curved portion generally of a ring shape when viewed from the other side in the first direction, the first curved portion has a first pair of generally arc shapes in a cross-sectional view in the first direction, the first pair of generally arc shapes protruding to one or the other side in the first direction, the damper portion includes a second curved portion generally of a ring shape when viewed from the other side in the first direction, the second curved portion has a second pair of generally arc shapes in a cross-sectional view in the first direction, the second pair of generally arc shapes protruding to one or the other side in the first direction, the first curved portion includes:

a first inner perimeter generally of a ring-shape, a first outer perimeter generally of a ring-shape, and a first vertex generally of a ring-shape, the first vertex is positioned between the first inner perimeter and the first outer perimeter and outside a first midpoint, the first midpoint is a midpoint of a linear distance from the first inner perimeter to the first outer perimeter, the second curved portion includes:

a second inner perimeter generally of a ring-shape, a second outer perimeter generally of a ring-shape, and a second vertex generally of a ring-shape, the second vertex is positioned between the second inner perimeter and the second outer perimeter and inside a second midpoint, and the second midpoint is a midpoint of a linear distance from the second inner perimeter to the second outer perimeter.

6. The vibratable element according to claim 1, wherein the first curved portion includes:

a first inner perimeter generally of a ring-shape, a first outer perimeter generally of a ring-shape, and a first vertex generally of a ring-shape, the first vertex is positioned between the first inner perimeter and the first outer perimeter and outside a first midpoint, the first midpoint is a midpoint of a linear distance from the first inner perimeter to the first outer perimeter, the second curved portion includes:

a second inner perimeter generally of a ring-shape, a second outer perimeter generally of a ring-shape, and a second vertex generally of a ring-shape, the second vertex is positioned between the second inner perimeter and the second outer perimeter and inside a second midpoint, and the second midpoint is a midpoint of a linear distance from the second inner perimeter to the second outer perimeter.

7. A vibratable element for loudspeaker use, the vibratable element comprising:

a coil bobbin;

a voice coil attached to the coil bobbin; and a main body constituted by a single thin plate, the main body including:

a fixing portion being a part of the thin plate to which the coil bobbin is fixed from one side in a first direction, the first direction being an axial direction of the voice coil, a damper portion being a part of the thin plate located inside the fixing portion, a vibrating portion being a part of the thin plate located outside the fixing portion, wherein the inside refers to a side toward the center of the thin plate and the outside refers to a side away from the center of the thin plate, and an edge portion being a part of the thin plate outside the vibrating portion, the edge portion including an outer perimeter portion of the thin plate, wherein the vibrating portion and the edge portion include a first curved portion generally of a ring shape when viewed from the other side in the first direction, the first curved portion has a first pair of generally arc shapes in a cross-sectional view in the first direction, the first pair of generally arc shapes protruding to one or the other side in the first direction, the damper portion includes a second curved portion generally of a ring shape when viewed from the other side in the first direction, the second curved portion has a second pair of generally arc shapes in a cross-sectional view in the first direction, the second pair of generally arc shapes protruding to one or the other side in the first direction, the first curved portion includes:

a first inner perimeter generally of a ring-shape, a first outer perimeter generally of a ring-shape, and a first vertex generally of a ring-shape, wherein the first vertex is positioned between the first inner perimeter and the first outer perimeter and outside a first midpoint, and the first midpoint is a midpoint of a linear distance from the first inner perimeter to the first outer perimeter, the second curved portion includes:

a second inner perimeter generally of a ring-shape, a second outer perimeter generally of a ring-shape, and a second vertex generally of a ring-shape, wherein the second vertex is positioned between the second inner perimeter and the second outer perimeter and inside a second midpoint, and the second midpoint is a midpoint of a linear distance from the second inner perimeter to the second outer perimeter, and first distance: second distance ≈ fourth distance: third distance, where a first imaginary line extending from the first inner perimeter to the first outer perimeter intersects at a first intersection with a second imaginary line extending from the first vertex in the first direction, a third imaginary line extending from the second inner perimeter to the second outer perimeter intersects at a second intersection with a fourth imaginary line extending from the second vertex in the first direction, and the first distance is a linear distance from the first inner perimeter to the first intersection, the second distance is a linear distance from the first intersection to the first outer perimeter, the third distance is a linear distance from the second inner perimeter to the second intersection, and the fourth distance is a linear distance from the second intersection to the second outer perimeter.

8. The vibratable element according to claim 1, wherein the first curved portion includes:

a first inner perimeter generally of a ring-shape, a first outer perimeter generally of a ring-shape, and a first vertex generally of a ring-shape, wherein the first vertex is positioned between the first inner perimeter and the first outer perimeter and outside a first midpoint, and the first midpoint is a midpoint of a linear distance from the first inner perimeter to the first outer perimeter, the second curved portion includes:

a second inner perimeter generally of a ring-shape, a second outer perimeter generally of a ring-shape, and a second vertex generally of a ring-shape, wherein the second vertex is positioned between the second inner perimeter and the second outer perimeter and inside a second midpoint, and the second midpoint is a midpoint of a linear distance from the second inner perimeter to the second outer perimeter, and first distance: second distance ≈ fourth distance: third distance, where a first imaginary line extending from the first inner perimeter to the first outer perimeter intersects at a first intersection with a second imaginary line extending from the first vertex in the first direction, a third imaginary line extending from the second inner perimeter to the second outer perimeter intersects at a second intersection with a fourth imaginary line extending from the second vertex in the first direction, and the first distance is a linear distance from the first inner perimeter to the first intersection, the second distance is a linear distance from the first intersection to the first outer perimeter, the third distance is a linear distance from the second inner perimeter to the second intersection, and the fourth distance is a linear distance from the second intersection to the second outer perimeter.

9. The vibratable element according to claim 7, wherein the ratio of the first distance to the second distance is in a range from about 5.5:4.5 to about 8:2, and the ratio of the fourth distance to the third distance is in a range from about 5.5:4.5 to about 8:2.

10. The vibratable element according to claim 2, wherein the first curved portion includes:

a first vertex generally of a ring-shape, a first inner part positioned inside the first vertex, and a first outer part positioned outside the first vertex, the first inner part of the first curved portion curves more gently than the first outer part of the first curved portion, the second curved portion includes:

a second vertex generally of a ring-shape, a second inner part positioned inside the second vertex, and a second outer part positioned outside the second vertex, and the second outer part of the second curved portion curves more gently than the second inner part of the second curved portion.

11. The vibratable element according to claim 5, wherein the first curved portion includes:

a first vertex generally of a ring-shape, a first inner part positioned inside the first vertex, and a first outer part positioned outside the first vertex, the first inner part of the first curved portion curves more gently than the first outer part of the first curved portion, the second curved portion includes:

a second vertex generally of a ring-shape, a second inner part positioned inside the second vertex, and a second outer part positioned outside the second vertex, and the second outer part of the second curved portion curves more gently than the second inner part of the second curved portion.

12. The vibratable element according to claim 1, further comprising a dome portion having a higher hardness than the main body, wherein the fixing portion has a first face on the one side in the first direction and a second face on the other side in the first direction, the coil bobbin is fixed to the first face of the fixing portion, and the dome portion is fixed to the second face of the fixing portion and covers the damper portion from the other side in the first direction.

13. A loudspeaker device comprising:

the vibratable element according to claim 1;

a magnetic circuit having a magnetic gap, the magnetic gap receiving the voice coil of the vibratable element;

a damper support fixed to the damper portion of the main body of the vibratable element; and a frame fixed to the outer perimeter portion of the edge portion of the main body of the vibratable element.

14. The vibratable element according to claim 5, wherein the first pair of generally arc shapes of the first curved portion and the second pair of generally arc shapes of the second curved portion protrude in mutually opposite directions in the first direction.

15. The vibratable element according to claim 5, further comprising a dome portion having a higher hardness than the main body, wherein the fixing portion has a first face on the one side in the first direction and a second face on the other side in the first direction, the coil bobbin is fixed to the first face of the fixing portion, and the dome portion is fixed to the second face of the fixing portion and covers the damper portion from the other side in the first direction.

16. The vibratable element according to claim 7, wherein the first pair of generally arc shapes of the first curved portion and the second pair of generally arc shapes of the second curved portion protrude in mutually opposite directions in the first direction.

17. The vibratable element according to claim 7, further comprising a dome portion having a higher hardness than the main body, wherein the fixing portion has a first face on the one side in the first direction and a second face on the other side in the first direction, the coil bobbin is fixed to the first face of the fixing portion, and the dome portion is fixed to the second face of the fixing portion and covers the damper portion from the other side in the first direction.

* * * * *